US006530492B2

(12) United States Patent
Weis

(10) Patent No.: US 6,530,492 B2
(45) **Date of Patent: *Mar. 11, 2003**

(54) TRANSPORTER CONTAINER-LOADING BRIDGE

(75) Inventor: Otto Weis, Oberpleichfeld (DE)

(73) Assignee: Noell Crane Systems GmbH, Würzburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,550

(22) PCT Filed: Feb. 12, 1998

(86) PCT No.: PCT/DE98/00407

§ 371 (c)(1),
(2), (4) Date: Aug. 16, 1999

(87) PCT Pub. No.: WO98/35905

PCT Pub. Date: Aug. 20, 1998

(65) Prior Publication Data

US 2002/0031419 A1 Mar. 14, 2002

(30) Foreign Application Priority Data

Feb. 14, 1997 (DE) ..... 197 05 670

(51) Int. Cl.[7] ..... B66C 19/00

(52) U.S. Cl. ..... 212/316; 212/325; 414/141.4; 414/141.7

(58) Field of Search ..... 212/316, 325, 212/326; 414/141.3, 141.4, 141.7

(56) References Cited

U.S. PATENT DOCUMENTS 3,881,608 A * 5/1975 Hupkes ..... 212/316 X
5,515,982 A * 5/1996 Hasegawa et al. ..... 212/316

FOREIGN PATENT DOCUMENTS

NL 51664 * 12/1941 ..... 212/316

* cited by examiner

*Primary Examiner*—Janice L. Krizek
(74) *Attorney, Agent, or Firm*—Cohen, Pontani, Lieberman & Pavane

(57) ABSTRACT

The invention relates to a transporter container-loading bridge comprising a two-armed traveling support, a lifting gear, a traveling mechanism and at least one portal, characterized in that at least two trolleys travel on individual tracks of the traveling support on the transporter container-loading bridge with their paths crossing. According to the invention, the running track of one trolley is located above and inside the track of the other trolley, wherein both trolleys travel along both sides of their running tracks. The invention provides the advantage that several trolleys can travel independently from each other without having to transfer, rotate or surrender their load.

6 Claims, 13 Drawing Sheets

TRANSPORTER CONTAINER-LOADING BRIDGE

PRIORITY CLAIM

This is a U.S. national stage of application No. PCT/DE98/00407, filed on Feb. 12, 1998. Priority is claimed on that application and on the following application:

Country: Germany, Application No. 197 05 670.9, filed: Feb. 14, 1997;

BACKGROUND OF THE INVENTION

1. Field of the Invention

The invention relates to a container bridge.

2. Discussion of the Prior Art

The container bridge can be used wherever a large number of loading units have to be transshipped in a short time. The container bridge is, above all, suitable for loading and unloading containers from ships onto stockyards or onto means of transport, by which they are transported further. German reference DE-A-2 341 725 discloses a bridge crane, in which two trolleys arranged one above the other are capable of traveling relative to one another. The upper trolley is capable of traveling on tracks which are located below the trolley, and the lower trolley is capable of traveling on tracks which are located above the trolley. The upper trolley travels over and beyond the trolley located below it, the load to be transported traveling through the U-shaped lower trolley. So that the container of the upper trolley does not collide with the U-shaped lower trolley, there has to be a rotary mechanism on the upper trolley, so that the container can be rotated in the longitudinal direction relative to the direction of movement and travel through the lower trolley is possible. This rotational movement of each container involves a certain amount of apparatus and, above all, takes up time during the loading of the containers.

Furthermore, in this bridge crane, the tracks of the trolleys are arranged outside the length of the container to be transported. The disadvantage of this is that problems may arise during takeover/transfer in the region of the ship's bridge, when the containers are to be stacked very far toward the bridge.

German reference DE 43 07 254 A1 discloses a transloading crane, in which three trolleys are arranged on a crane bridge, two lifting units capable of traveling in their longitudinal direction and having a lifting mechanism being arranged for the exchange of loads with a transfer unit. The transfer unit can move loads or containers on two levels, the transfer unit itself not possessing a lifting unit. It is possible, furthermore, for each traversable lifting unit having a lifting mechanism also to travel through the transfer unit. It is not possible, however, for the trolleys having a lifting unit and the containers to travel one through the other, since the arrangement of their paths and their design do not allow this. In this transloading crane, too, there is therefore no device in which a plurality of trolleys, together with their load, can operate fully independently of one another.

SUMMARY OF THE INVENTION

The object of the present invention is therefore to provide a container bridge on which a plurality of trolleys can operate essentially independently of one another, at a low outlay in terms of time and material, while all the trolleys are to be provided with a lifting means.

The container bridge according to the invention includes of a two-armed traveling support, a lifting mechanism, a traveling mechanism and at least one gantry. The trolleys travel in each case on their own tracks of the traveling support on the container bridge and their paths cross one another. The two-armed traveling support is constructed as a frame boom with two longitudinal arms which are connected together. The longitudinal arms of the two-armed traveling support have the travel paths for the trolleys.On the basis of two trolleys, the tracks of which cross one another, it is advantageous if the trolleys travel on their tracks on both sides.

According to the invention, the tracks of both trolleys are arranged above the trolleys. The advantage of this is that the trolleys, together with their gripping means, can transport containers independently of one another also transversely to the direction of travel.

It is expedient for the lower most trolley in each case to have a U-shaped or trough-shaped design, so that this lower trolley has a cavity through which the upper trolley, together with its load, for example a container, can travel.

Each of the trolleys is equipped with all the devices which are necessary for longitudinal, lifting and gripping travel. This also includes each of the trolleys having its own driver's cab in the event of manual operation. It is advantageous if the lifting mechanism of the lower trolley is divided in two and is arranged next to the longitudinal traveling mechanism. In order to divert the horizontal forces onto the side parts, guide rollers and guide rails are mounted between the trolley and the main support. This arrangement gives rise to a compact design.

The trolleys of the container bridge are equipped with signal means which prevent mutual collision while a load is being carried. This ensures that the upper trolley which has a lowered load or a lowered container does not collide with the path of the lower trolley.

The two trolleys can therefore load and unload vehicles and stockyards essentially independently of one another, each of the two trolleys being capable of traveling over and attending to the entire region of the container bridge.

It is advantageous furthermore, if at least one side of the traveling support projecting beyond the gantry is capable of being swung up. This is advantageous, above all, when container ships coming to land require this or else this region of the container bridge is not in use.

In a further embodiment of the invention, the tracks of the trolleys run on both sides of a single support. This design is suitable particularly for cases where containers having relatively small loads are to be transported quickly.

In another embodiment of the invention, each trolley can travel on another support in each case.

It is advantageous to arrange the tracks of the trolleys within the length of a transversely transported container. The containers can thereby be stacked very far toward the ship's bridge without problems.

The container bridge according to the invention is explained in more detail below with reference to ten figures and one embodiment.

DETAILED DESCRIPTION OF THE PREFERRED EMBODIMENTS

Figure 1:
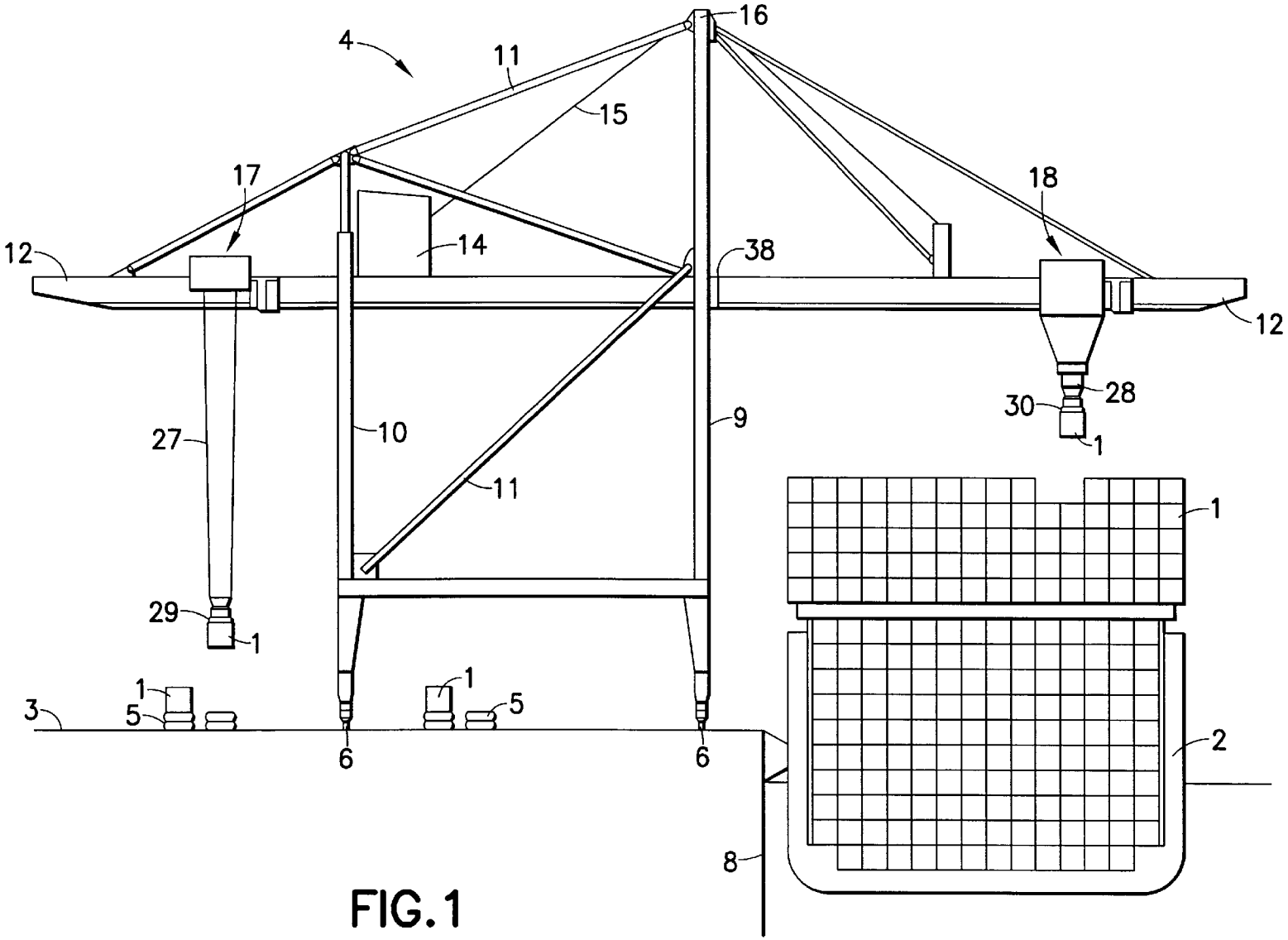
FIG. 1 shows a view of the container bridge according to the invention during the transshipment operation, with the trolley 17 in the position of transfer on land and the trolley 18 in the operation of transshipping on a ship.
Figure 2:
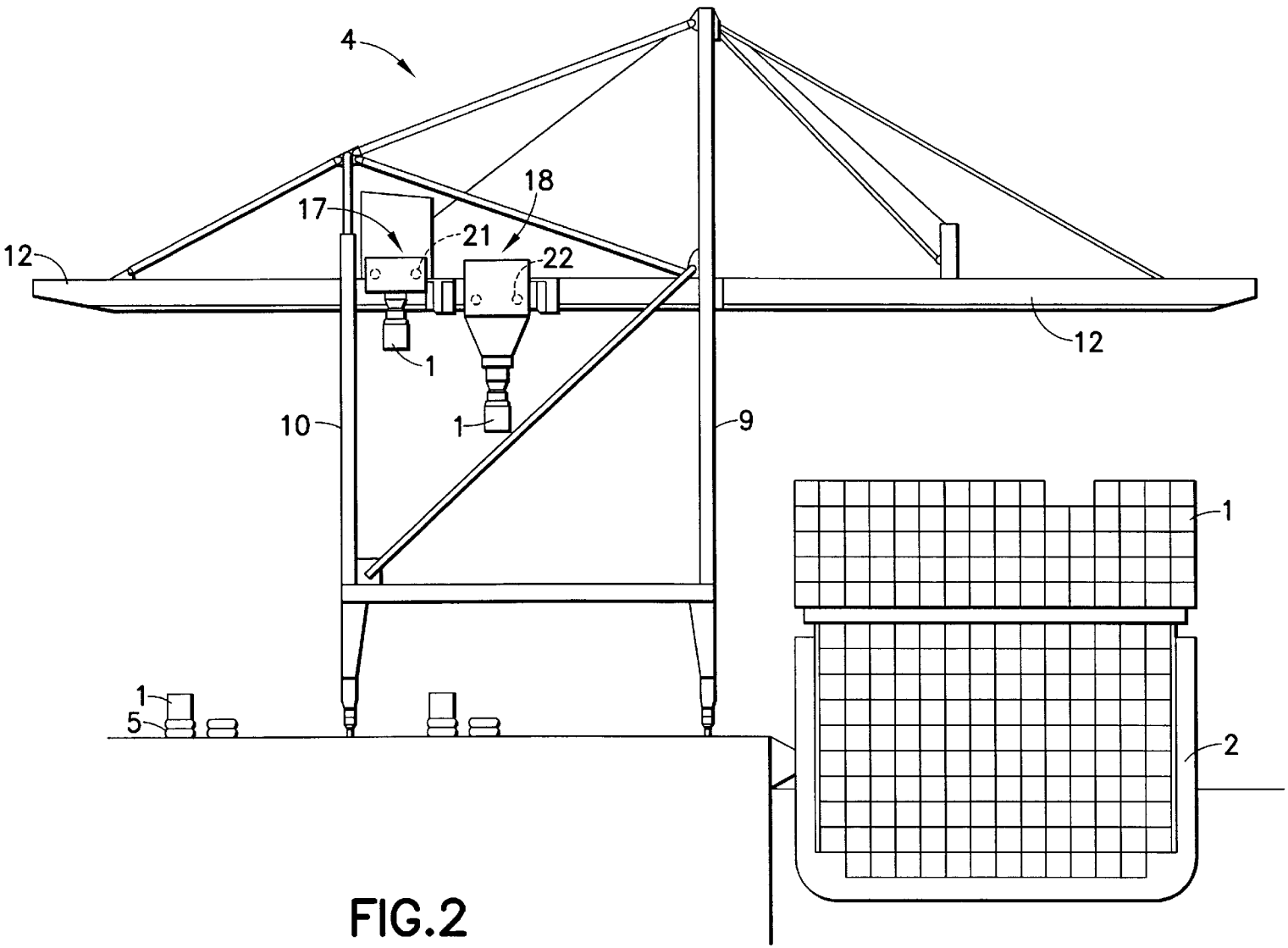
FIG. 2 shows a view of FIG. 1, with operation of the two trolleys 17 and 18 crossing one another within the gantries 9 and 10.
Figure 3:
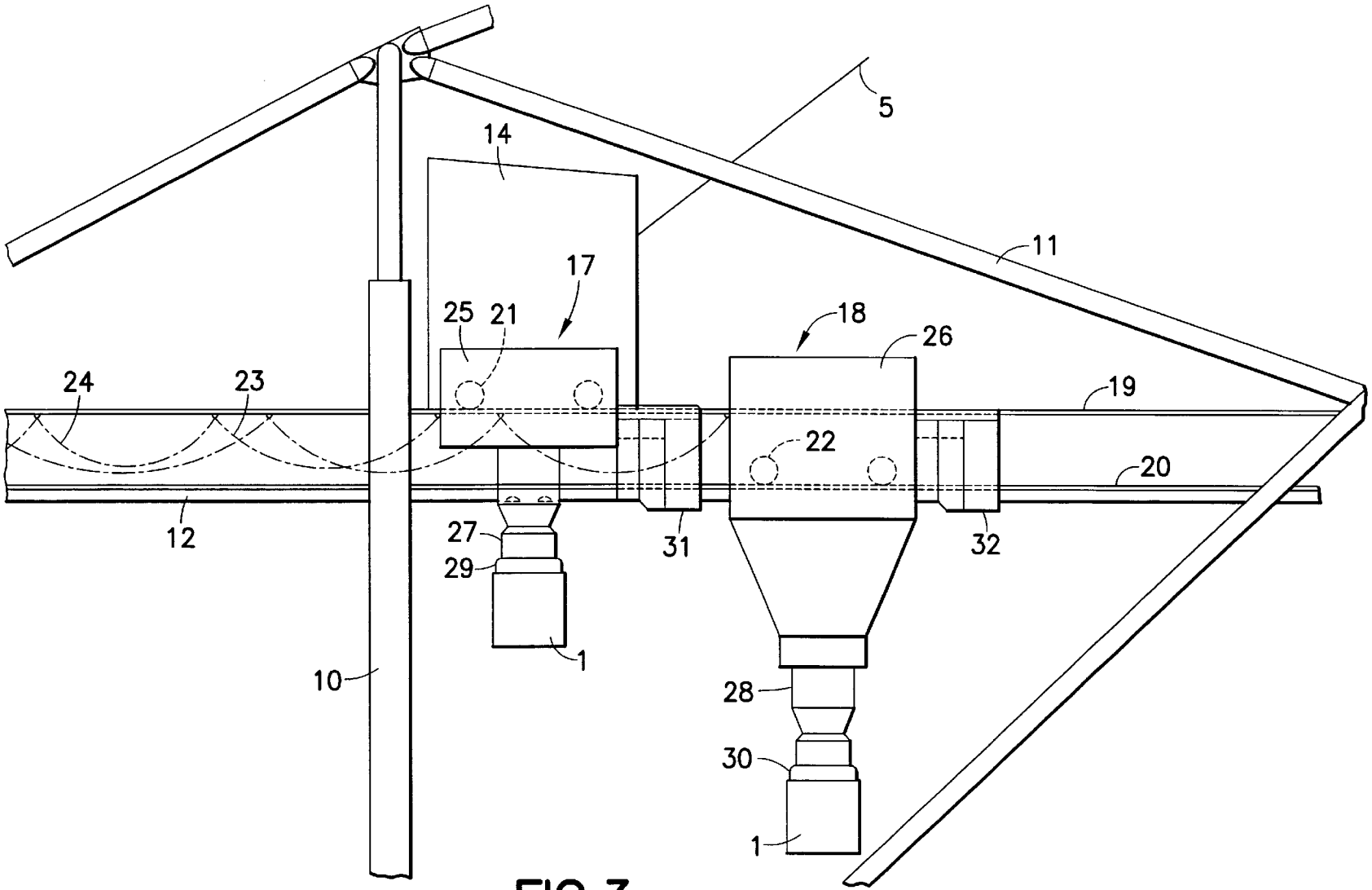
FIG. 3 shows a detail of the crossing operation from FIG. 2, with the trolley 17 traveling within the traveling support 12 and the trolley 18 traveling outside the traveling support.
Figure 4:
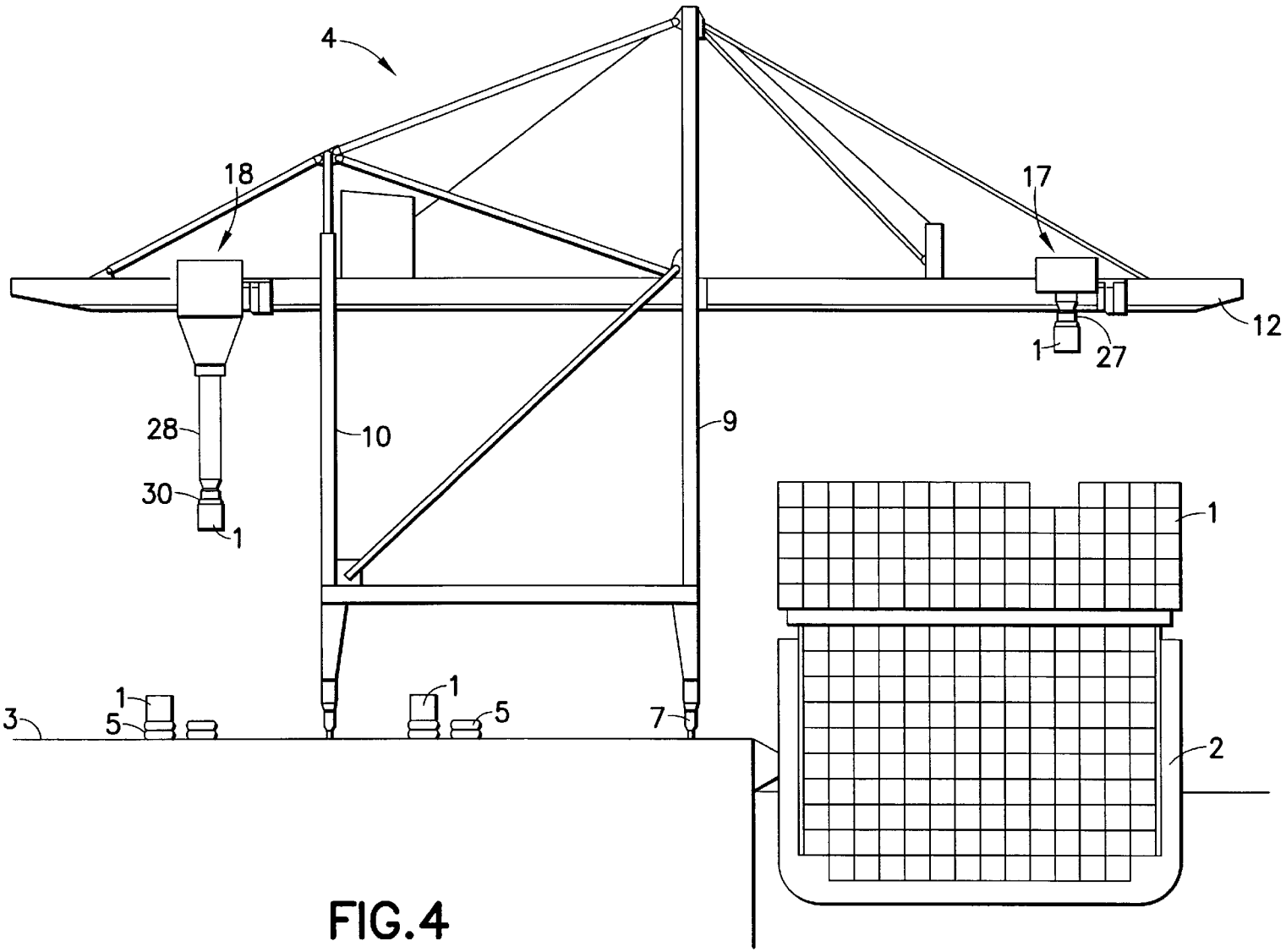
FIG. 4 shows a view of FIG. 1, with the two trolleys 17 and 18 in an interchanged position.
Figure 5:
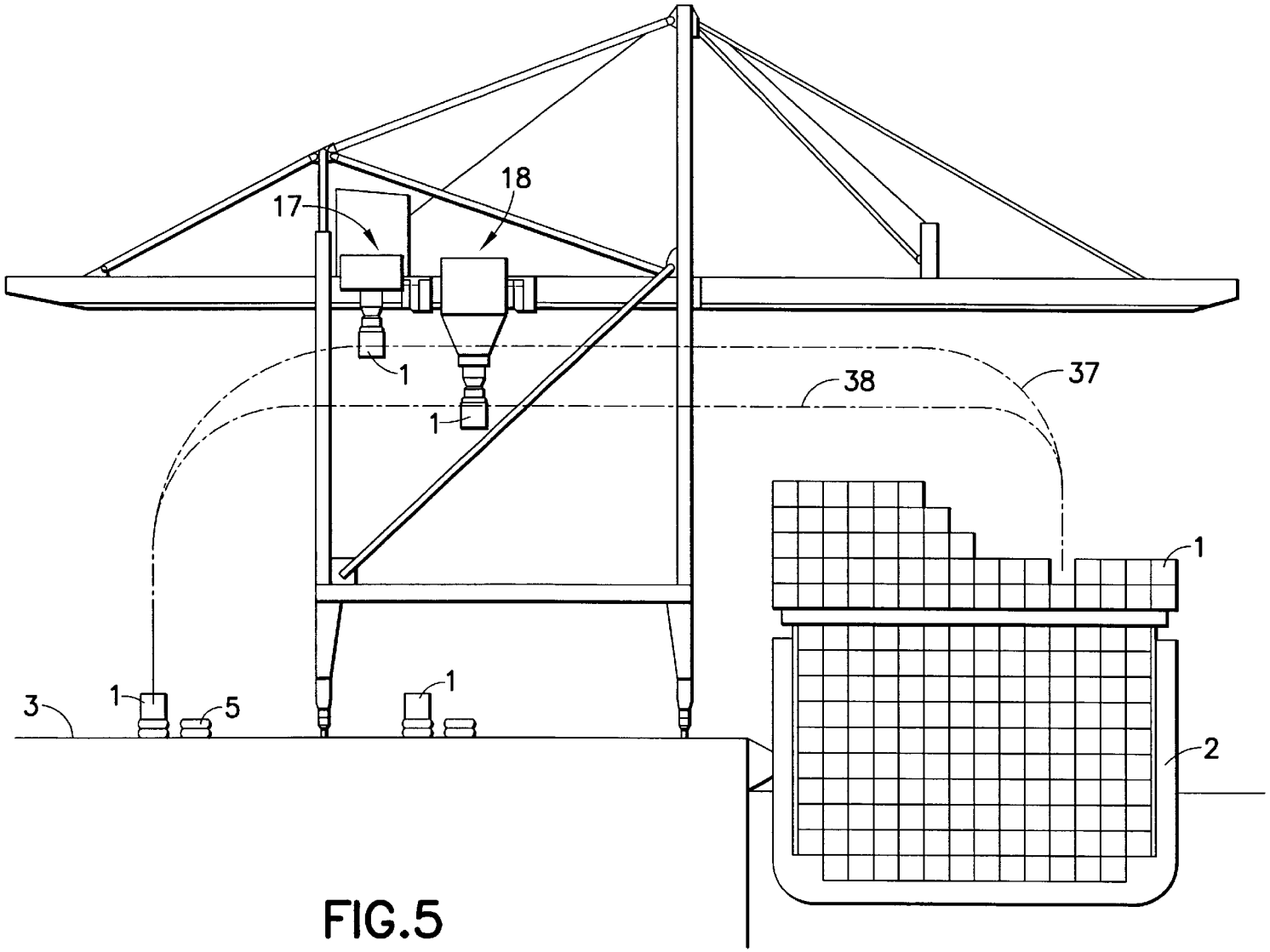
FIG. 5 shows a longitudinal illustration of the lines of movement 37, 38 of the trolleys 17 and 18.
Figure 6:
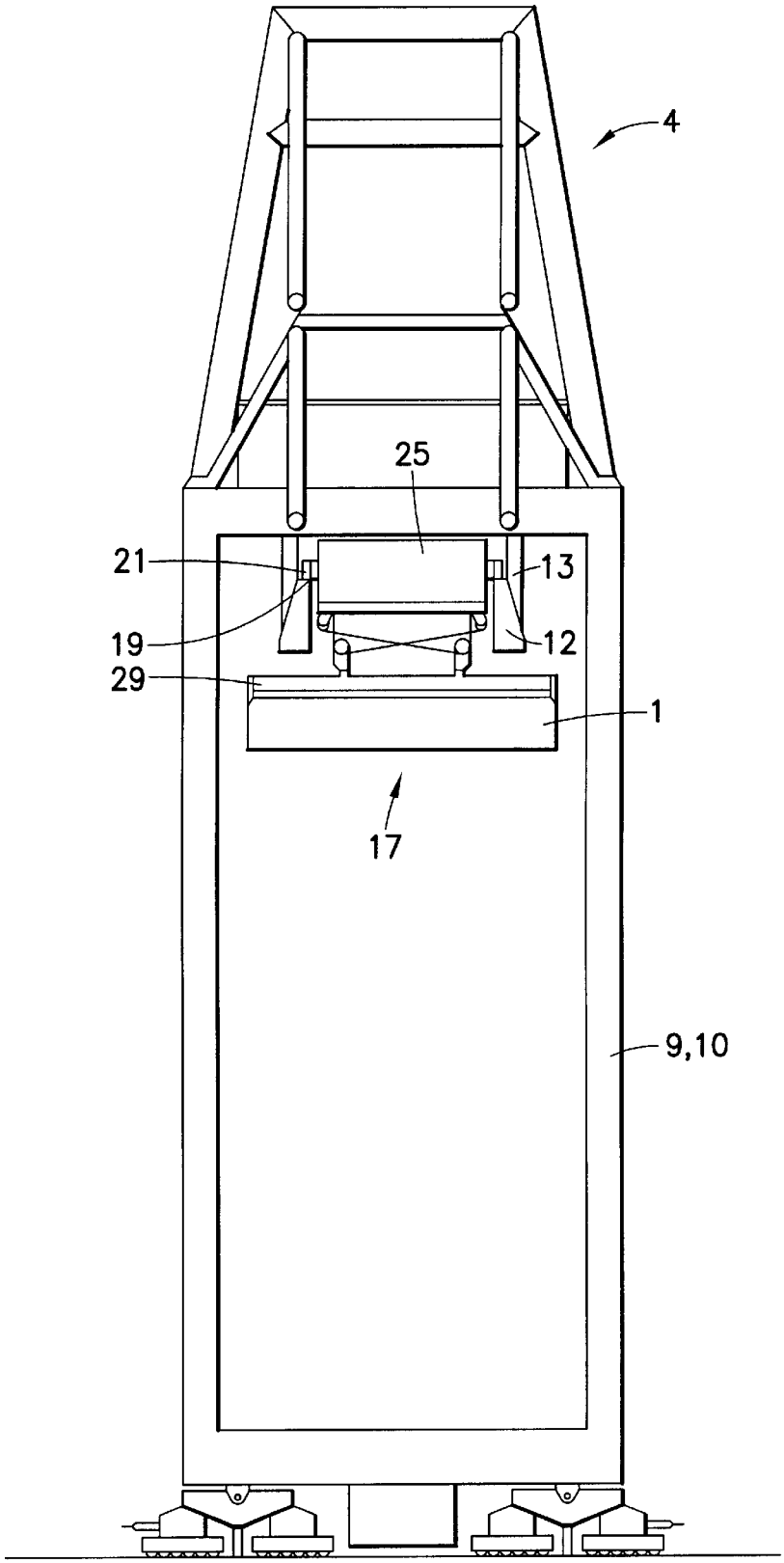
FIG. 6 shows a cross section with the trolley 17 and the container 1 on the traveling support 12.
Figure 7:
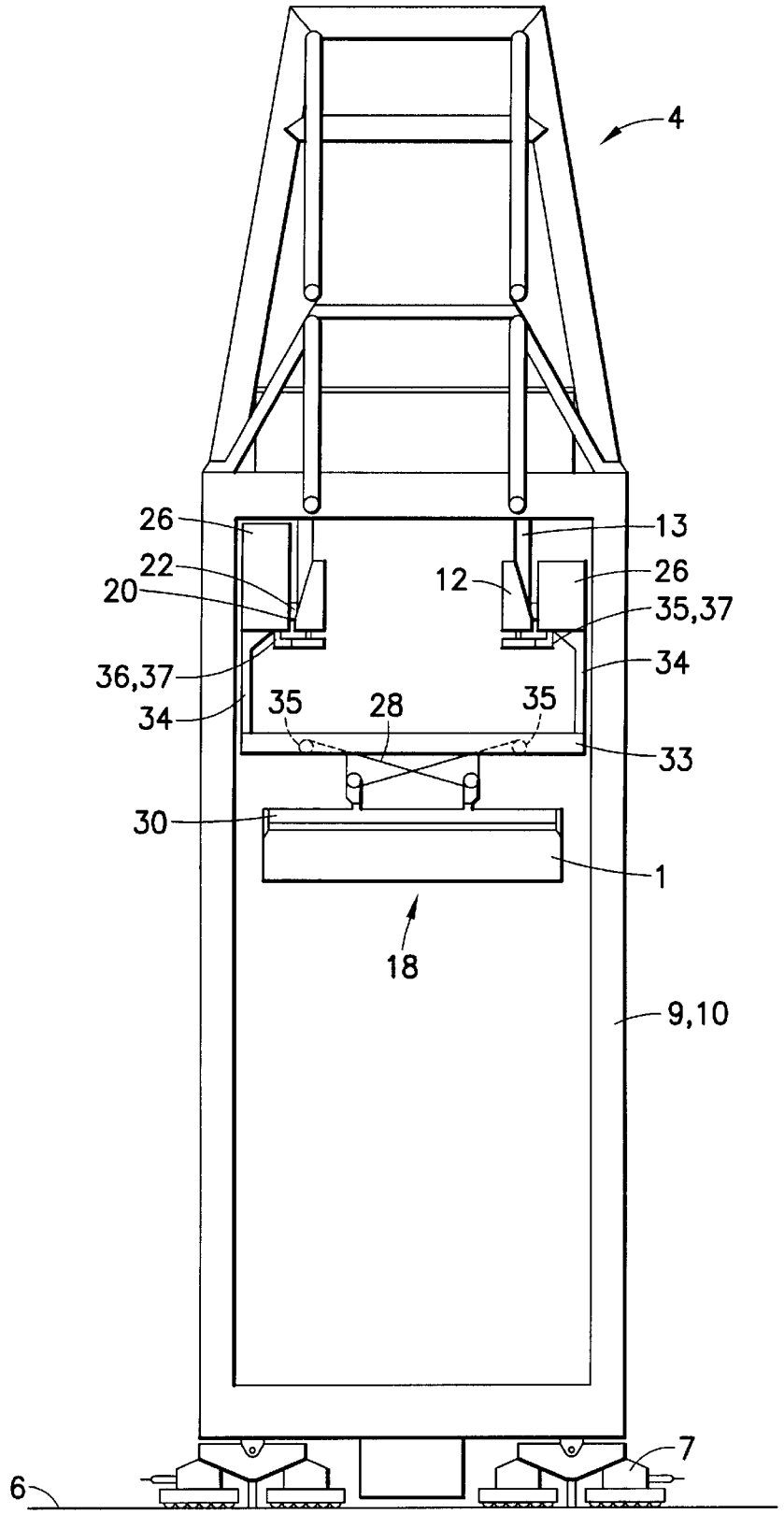
FIG. 7 shows a cross section with the trolley 18, together with the container 1, on the traveling support 12.
Figure 8:
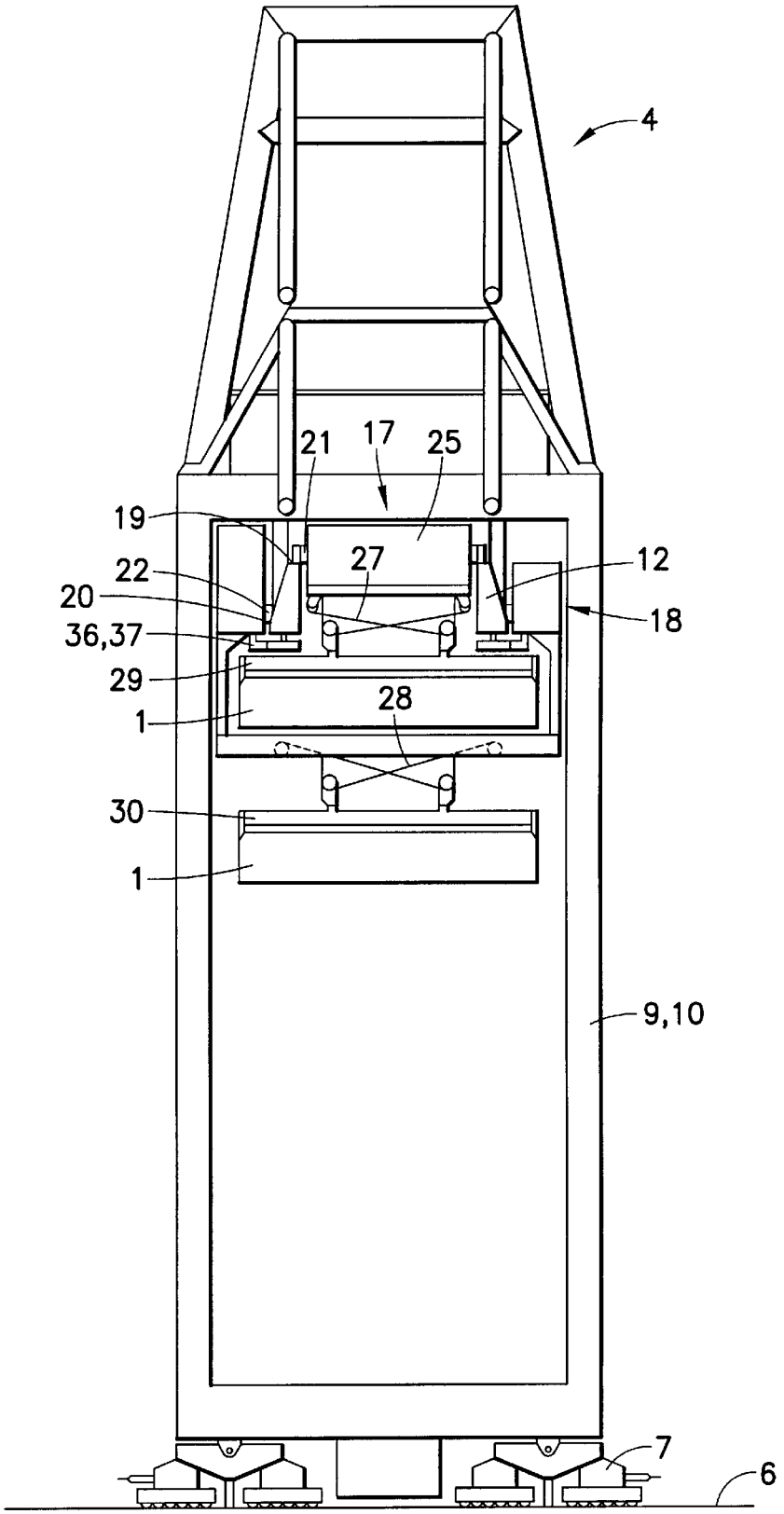
FIG. 8 shows a cross section of the two trolleys 17 and 18, each with a container 1, in the crossing region on the traveling support 12.
Figure 9:
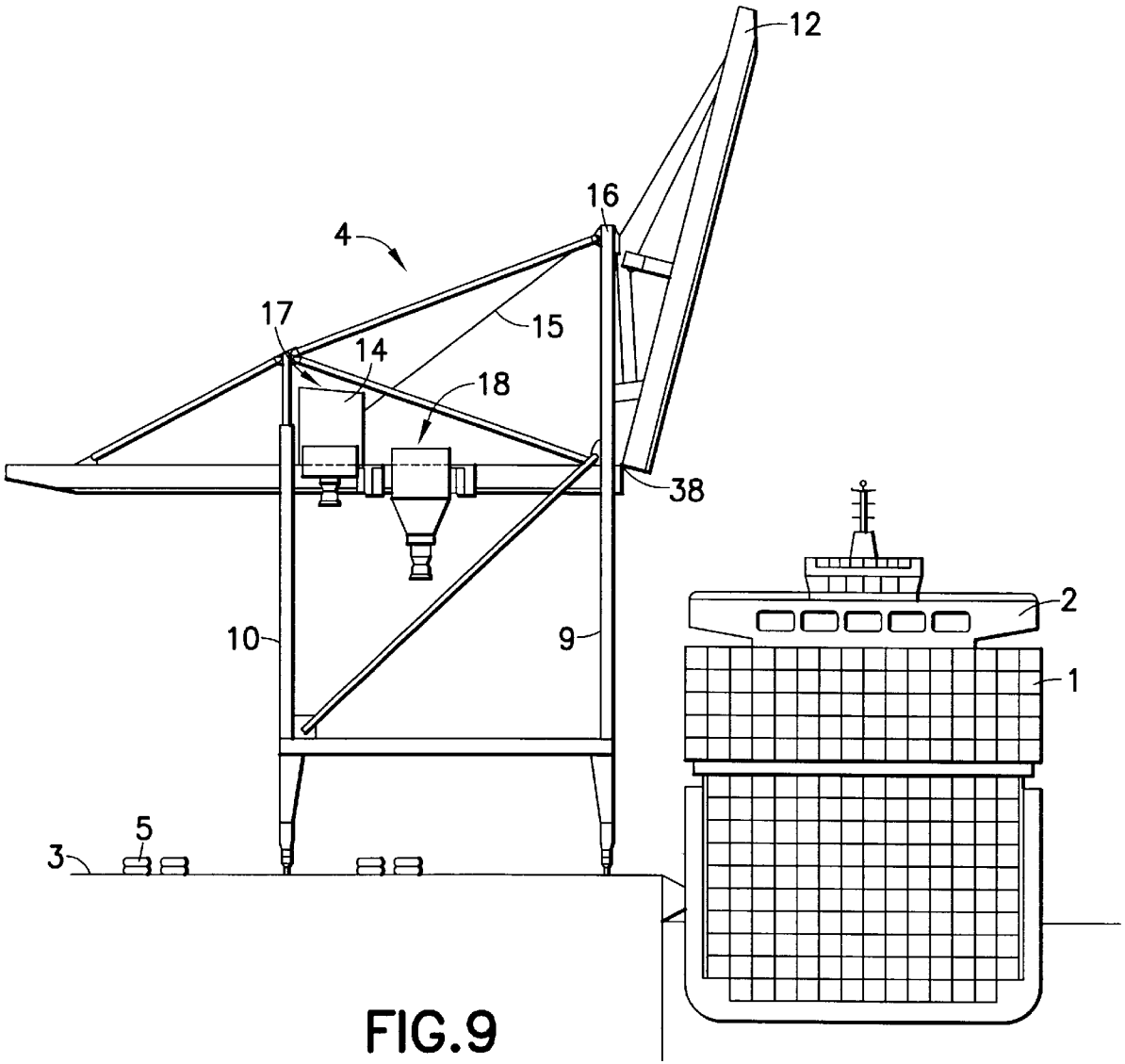
FIG. 9 shows a view of the container bridge, with the jib swung up and with the two trolleys 17 and 18.

FIGS. 1 to 9 show the container bridge 4 according to the invention during the transshipment of a container 1 from a ship 2 to land 3. Depending on the size of the ship 2, a plurality of container bridges 4 may be used simultaneously. On land, the containers 1 are handled further by means of a transport 5.

The container bridge 4 travels parallel to the quay or pier edge 8 via traveling rails 6 embedded in the ground and via a traveling mechanism 7. A two-armed traveling support 12 is fastened via connecting elements 13 to a water-side gantry 9 and a land-side gantry 10 having reinforcing struts 11. The water-side traveling support 12 projecting beyond the gantry 9 may be swung up for the docking and undocking of the ships 2 via a joint 38 and a lifting mechanism 14 with ropes 15 and deflecting pulleys 16.

The two trolleys 17, 18 travel on the traveling support 12. Each trolley is equipped with all the devices for longitudinal, lifting and gripping travel. Each trolley therefore possesses its own track 19, 20, a longitudinal traveling mechanism 21, 22, a power supply 23, 24, a lifting mechanism 25, 26 with ropes 27, 28, a container spreader 29, 30 and, for manual operation, in each case a driver's cab 31, 32.

In the case of the trolley 18, the rope 28 is led to the spreader 30 via a lower part 33, two side parts 34 and deflecting pulleys 35. The actual lifting mechanism 26 is mounted, divided in two, next to the longitudinal traveling mechanism 22. In order to divert horizontal forces onto the side parts 34, guide rollers 36 and guide rails 37 are mounted between the trolley 18 and the traveling support 12. This arrangement results in a compact design.

The unloading operation proceeds as follows: After the ship 2 has been berthed, the container bridge 4 is moved into position via the traveling mechanisms 7 in order to unload the containers 1. The trolley 17 (FIG. 4) takes over a container 1 from the ship 2 by means of the spreader 27 and draws the container into the uppermost end position of the trolley 17. The container 1 is thereby in a stable position and is prevented from oscillating.

By means of the trolley traveling mechanism 21 (FIG. 2), the trolley 17 travels in the inner region of the two-armed traveling support 12 into the space between the container bridge gantries 9, 10. When this position is reached, a travel-on signal is communicated to the trolley 18 which, for example, is already waiting. The two trolleys move toward one another (FIG. 8), crossing taking place. At the same time, the trolley 18 travels in the outer region of the two-armed traveling support 12 and travels with its trough-like lower part 33 and the side parts 34 around the container 1 to be transported by means of the trolley 17.

The two trolleys 17, 18 continue their travel independently of one another (FIG. 5), for example the trolley 17 for discharging the container 1 on land and the trolley 18 for picking up a container 1 in the ship or, in the case of simultaneous loading and unloading, for discharging a container 1.

The line of movement of the container 1 runs essentially along an upper line 37 in the case of the trolley 17 and along a lower line 39 in the case of the trolley 18. The lower line 39 and the entire space below this line correspond to the single-trolley container bridge used hitherto.

Figure 10:
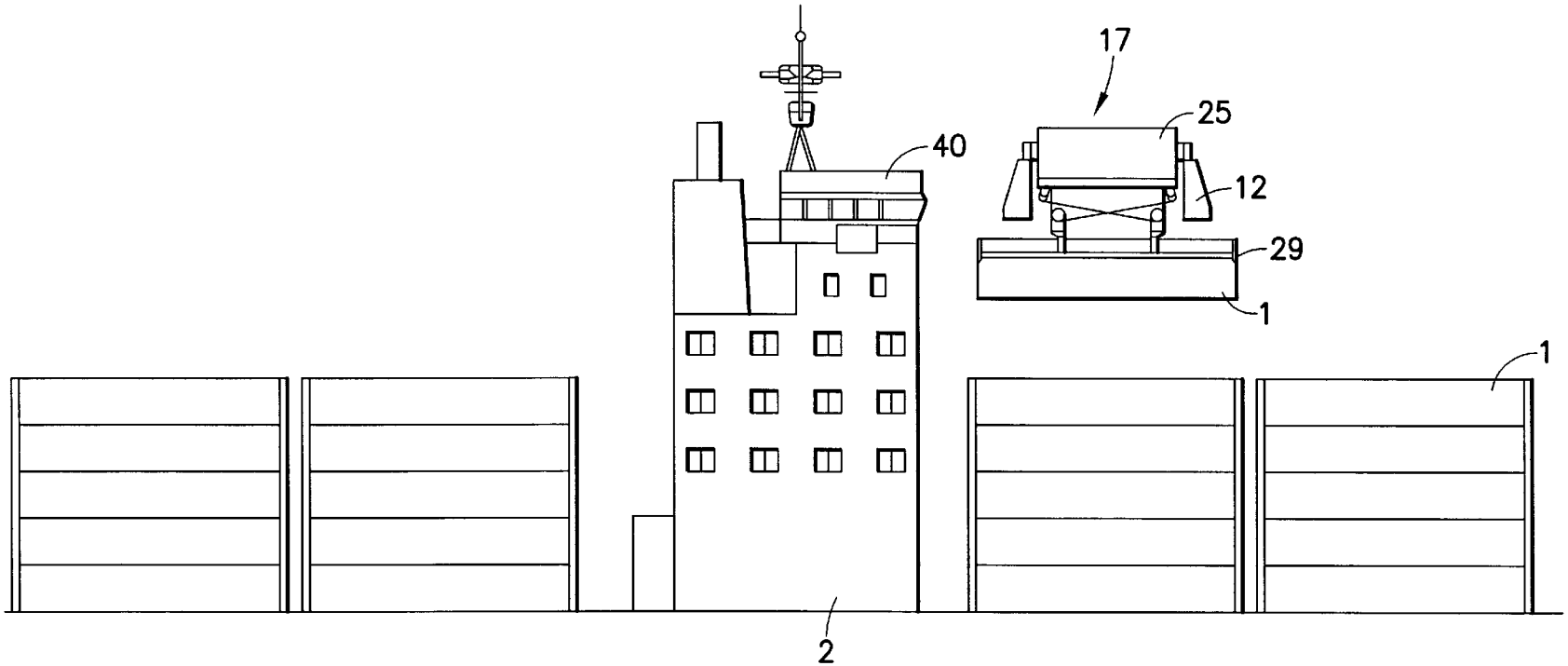
FIG. 10 shows the two-armed traveling support 12, with the trolley 17 arranged within the traveling supports, above the ship in the region of the ship's bridge 40.

By means of the two-armed traveling support 12, as illustrated in FIG. 10, and the trolley 17 running within the traveling support 12, containers can be handled directly up to the side of obstructing edges, for example ship's bridges 40. Here too, in the case of greater distances, the second trolley 18 may be used.

The advantage of the method is that the container remains connected to the respective spreader over the entire transport distance, even when the paths of the two trolleys cross one another. As a result of this crossing taking place within the container bridge gantries, no additional moments or loads are exerted on the crane rails.

Figure 11:
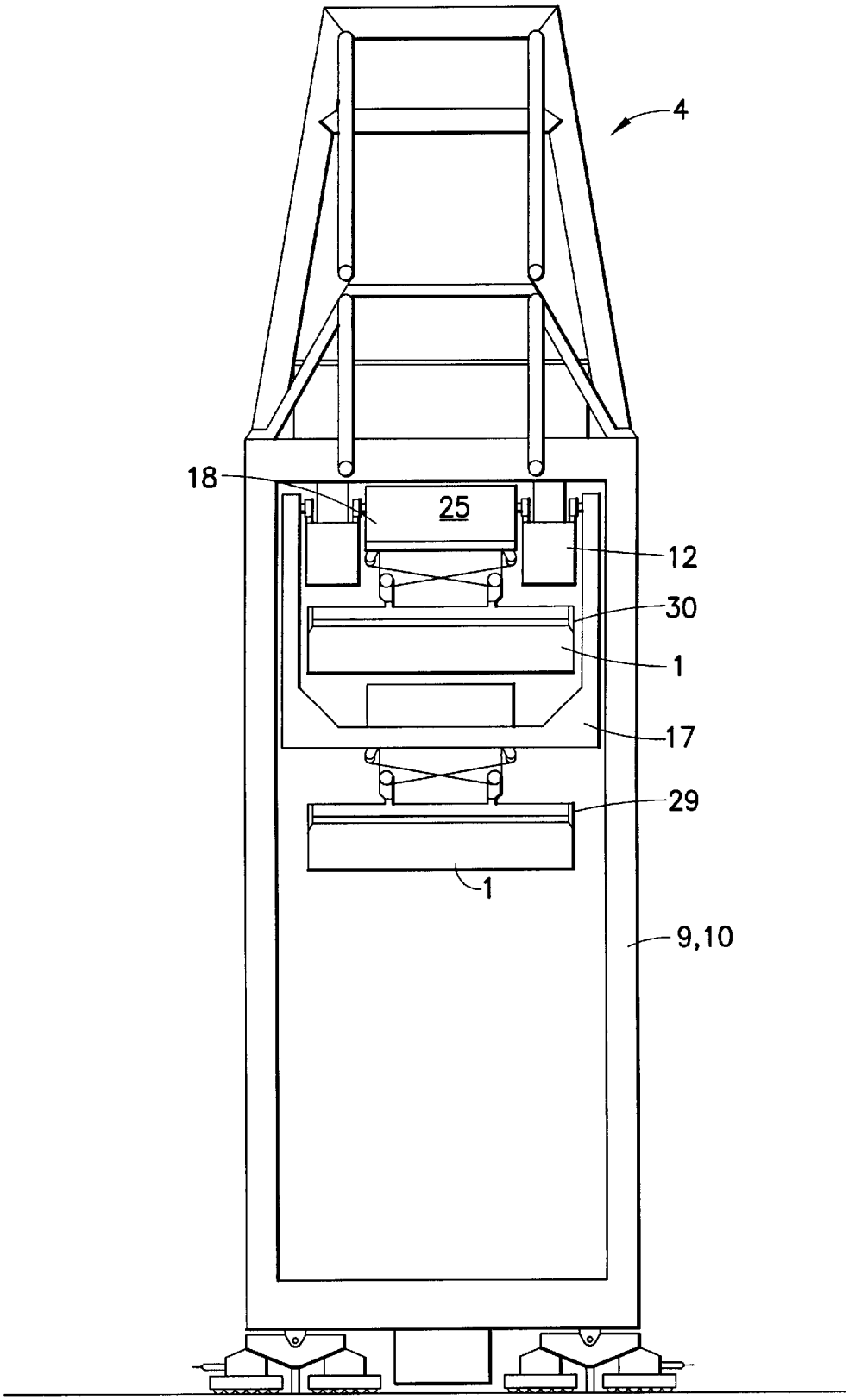
FIG. 11 shows a view of a container bridge, in which two trolleys 17, 18 are arranged on one traveling support 12.
Figure 12:
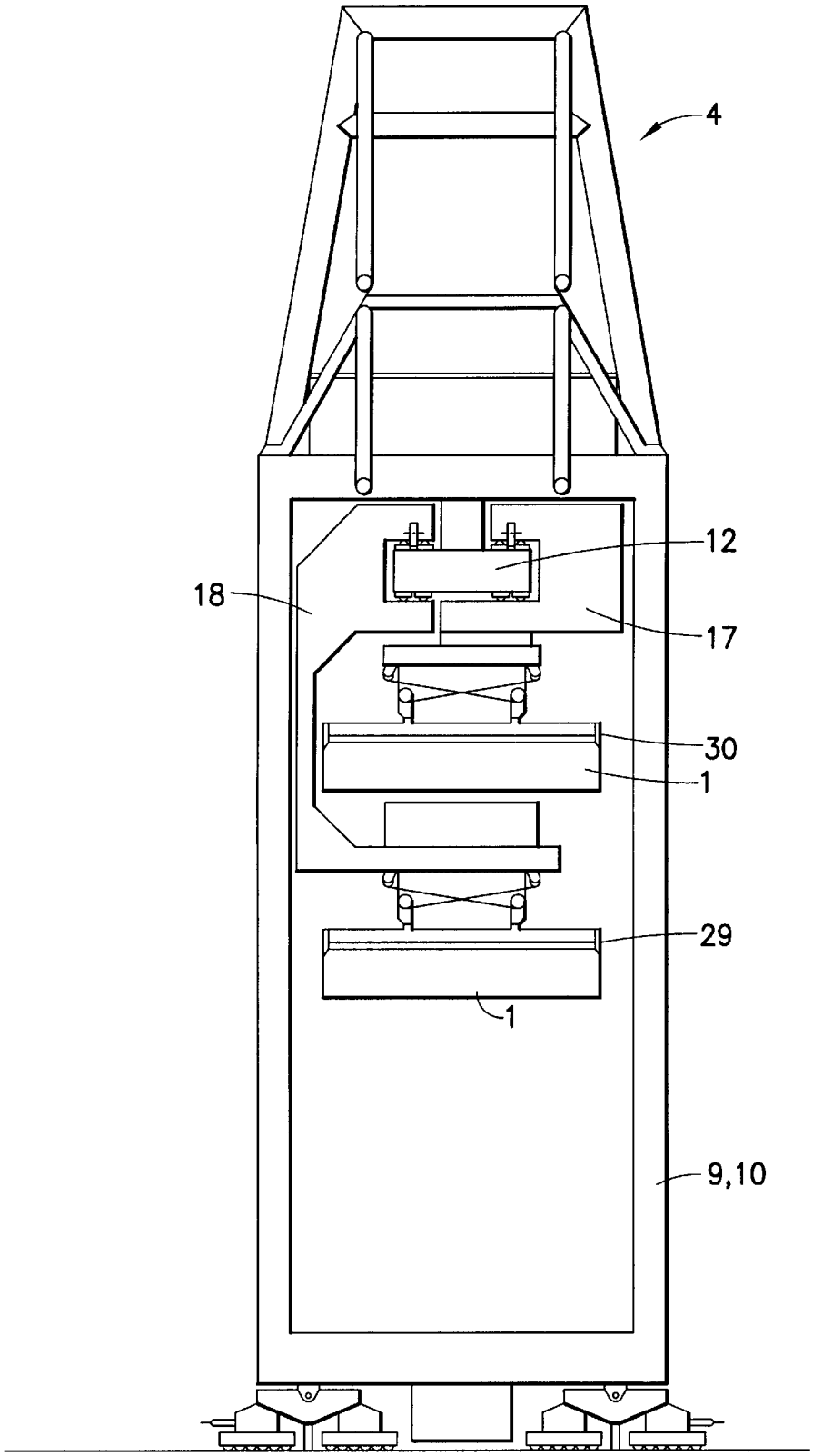
FIGS. 12 and 13 show a view of a container bridge, in which two trolleys 17, 18 comprising two traveling supports 12 are arranged, each trolley 17, 18 having its own traveling support.
Figure 13:
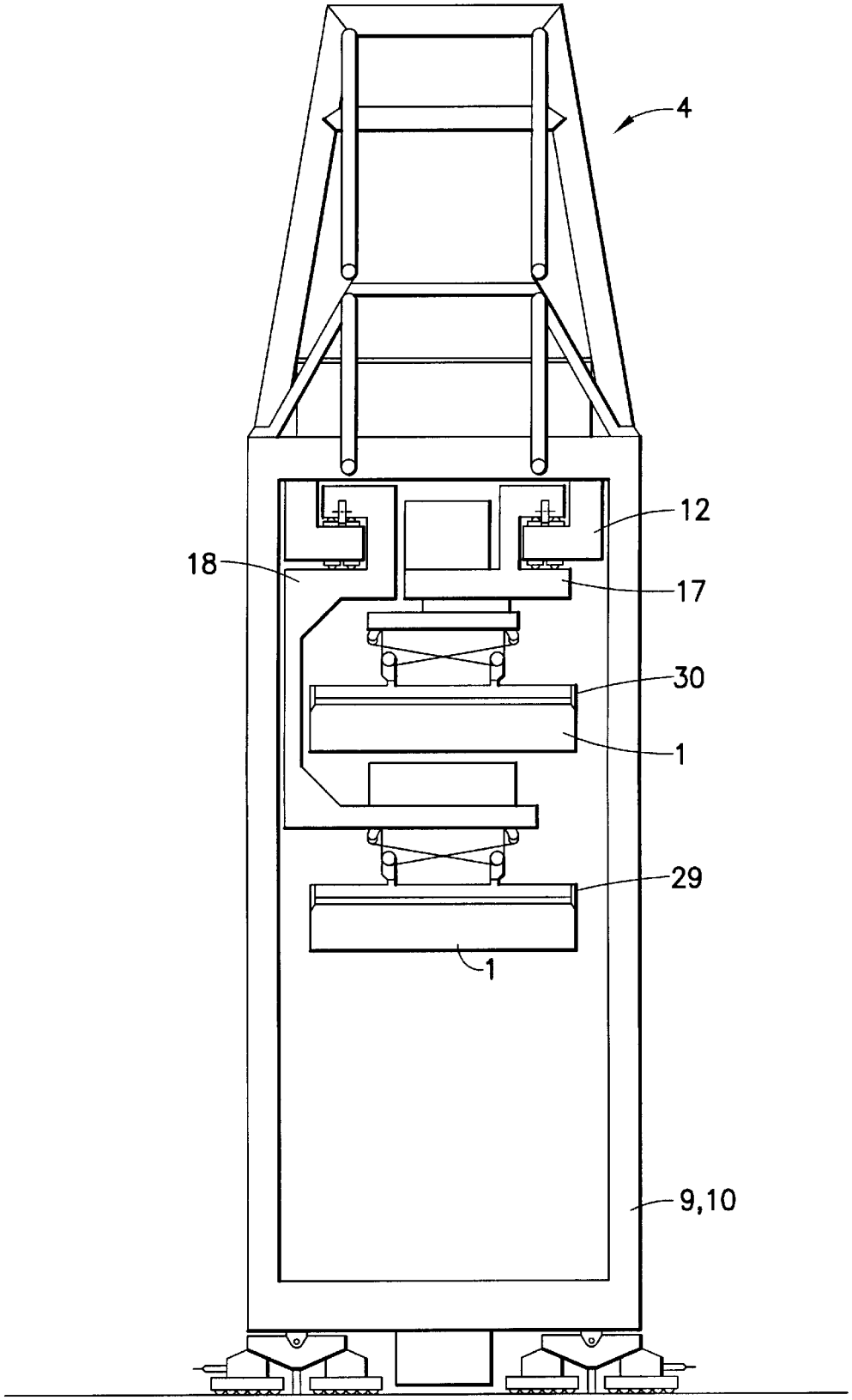

Furthermore, it becomes clear from FIG. 10 that, since the tracks 19, 20 of the trolleys 17, 18 are located within the container length, stacking can be carried out particularly far up to the ship's bridge 40. Design variants as to how the container bridge according to the invention may also be designed may be gathered from FIGS. 11 and 12.

What is claimed is:

1. A container bridge, comprising:

a gantry having an upper horizontal member;

two traveling supports on the gantry, the traveling supports having tracks supported from the upper horizontal member of the gantry so as to be beneath the upper horizontal member;

at least two trolleys suspended on the tracks of the traveling supports, the tracks of a first one of the trolleys and the tracks of a second one of the trolleys being at a smaller distance from one another than a length of a longest container to be transported; and a respective lifting mechanism arranged on each of the trolleys, each lifting mechanism including devices for longitudinally moving the trolley along the traveling supports, and for gripping and lifting a container, the trolleys each being arranged to travel on respective tracks of the traveling supports so that a center of gravity of each container is below the tracks and so that travel paths of the trolleys cross one another so that the trolleys pass one another when traveling along their respective travel paths without either trolley requiring rotation of a suspended container to permit passing, the tracks being arranged in each case on a different traveling support.

2. A container bridge as defined in 1, wherein the lifting device of the second trolley is divided in two and arranged next to the longitudinal traveling device.

3. A container bridge as defined in claim 1, and further comprising signal devices arranged on the trolleys to prevent mutual collision.

4. A container bridge as defined in claim 1, wherein each of the traveling supports has at least one side that projects beyond the gantry which can be swung up.

5. A container bridge, comprising:

a gantry having an upper horizontal member;

a traveling support on the gantry, the traveling support having two sides and tracks supported from the upper horizontal member of the gantry so as to be beneath the upper horizontal member;

at least two trolleys suspended on the tracks of the traveling support, the tracks of a first one of the trolleys and the track of a second one of the trolleys being at a smaller distance from one another than a length of a longest container to be transported; and a respective lifting mechanism arranged on each of the trolleys, each lifting mechanism including devices for longitudinally moving the trolley along the traveling supports, and for gripping and lifting a container, the trolleys each being arranged to travel on respective tracks of the traveling support so that a center of gravity of each container is below the tracks, and travel paths of the trolleys cross one another so that the trolleys pass one another when traveling along their respective travel paths, the tracks being arranged on both sides of the traveling support.

6. A container bridge as defined in claim 5, and further comprising signal devices arranged on the trolleys to prevent mutual collision.

* * * * *